United States Patent [19]

Buisker et al.

[11] Patent Number: 5,072,414

[45] Date of Patent: Dec. 10, 1991

[54] ULTRASONIC WEB EDGE DETECTION METHOD AND APPARATUS

[75] Inventors: Raymond A. Buisker, Madison; Erich T. Ziemann, Middleton; James Martyn, Madison, all of Wis.

[73] Assignee: AccuWeb, Inc., Madison, Wis.

[21] Appl. No.: 388,088

[22] Filed: Jul. 31, 1989

[51] Int. Cl.[5] ..... B65H 26/00

[52] U.S. Cl. ..... 364/550; 226/45

[58] Field of Search ..... 226/18, 45; 364/550; 367/96, 118

[56] References Cited

U.S. PATENT DOCUMENTS

| | | | |
|---|---|---|---|
| 3,225,988 | 12/1965 | Drenning | 226/19 |
| 3,342,284 | 9/1967 | Baird | 73/159 |
| 3,548,641 | 12/1970 | Mitchell | 73/609 |
| 3,567,091 | 3/1971 | Woolard | 226/18 |
| 3,570,624 | 3/1971 | O'Connor | 226/45 X |
| 3,693,855 | 9/1976 | Bonner | 226/19 |
| 3,724,732 | 4/1973 | Bonner | 226/21 |
| 3,767,131 | 10/1973 | Ott, Jr. | 242/57.1 |
| 3,912,193 | 10/1975 | Calvaer | 242/57.1 |
| 4,212,422 | 7/1980 | Rauchfuss, Jr. et al. | 226/196 |
| 4,247,204 | 1/1981 | Merlen et al. | 356/431 |
| 4,493,065 | 1/1985 | Sword, Jr. | 367/96 |
| 4,648,539 | 3/1987 | Dingerkus | 226/19 |
| 4,694,181 | 9/1987 | Piller | 250/548 |
| 4,760,945 | 8/1988 | Zerle | 226/18 |
| 4,901,292 | 2/1990 | Schrauwen | 367/118 |
| 4,963,807 | 10/1990 | Wendling | 318/632 |

OTHER PUBLICATIONS

The Ultrasonic Edge Sensor: Model US 2000, General Web Dynomis Flyer.

AccuGuide Electronic Web Guide, AccuWeb advertisement.

Pulsonic, Ultrasonic, Non-Contact Measuring System, Cleveland Machine Controls, Inc. brochure.

*Primary Examiner*—Parshotam S. Lall
*Assistant Examiner*—Edward R. Cosimano
*Attorney, Agent, or Firm*—Quarles & Brady

[57] ABSTRACT

The edge of a web of material is inserted into a gap in a detector head between an ultrasonic blockage transmitter and an ultrasonic blockage receiver such that the magnitude of the pulse of sound from the transmitter that is received by the receiver is related to the portion of the web that blocks the beam of sound and thereby the position of the edge of the web. The ultrasonic frequency of each pulse is preferably very high to provide a narrow beam. The second half of the electronic drive pulse to the transmitter is preferably 180° out of phase with the first half of the pulse to reduce excessive ringing of the transmitter. A compensation transmitter and compensation receiver, which are mounted proximate to the blockage transmitter and the blockage receiver, transmit similar sound signals across the gap but are unoccluded by the web. The apparatus includes a controller with a microprocessor which:

(A) receives the electrical pulses from the two receivers, (B) determines the peak values of the pulses, (C) averages pulse peak values to provide averaged values which reduce the effect of spurious signals variations, and (D) normalizes the value of the blockage receiver signal with the compensation receiver signal to compensate for transient changes in ambient conditions, to provide an error correcting output signal which can be used to bring the position of the web back to a desired position.

32 Claims, 7 Drawing Sheets

ULTRASONIC WEB EDGE DETECTION METHOD AND APPARATUS

FIELD OF THE INVENTION

This invention pertains generally to machines for the handling of web and sheet materials and particularly to apparatus for monitoring the position of the edge of a moving web to allow the position of the moving web to be controlled.

BACKGROUND OF THE INVENTION

In the handling of various types of web and sheet materials, it is important to be able to accurately position the moving material to ensure that the material remains on track and precisely aligned for various subsequent operations, such as cutting, slicing, printing and the like. Edge detectors which detect the lateral position of the edge of the moving web are utilized in such industries as paper making and converting, where the moving material is paper or nonwoven fibrous webs, in the printing industry, for photographic film manufacturing, and in the plastic packaging and forming industry.

A variety of techniques have been utilized to sense the position of the moving web, including photoelectric sensors in which the amount of interruption of a beam of light by the web is detected, air sensors in which a moving stream of air is directed across the edge of the web and the occlusion of the air is detected, and ultrasonic sensors which direct a beam of ultra-high frequency sound across the edge of the web and detect the amount of occlusion of the beam by the web. These transducers provide an electrical signal which is related to the lateral position of the web, with this signal being utilized to control positioning mechanisms to bring the moving web back to its desired edge position. Ultrasonic edge position detectors have a number of advantages over photoelectric and air transducers, particularly with transparent or translucent web material such as thin paper sheets or transparent plastic, where photoelectric sensors may be difficult or impossible to use.

In an ultrasonic web edge detector, a sound emitting transducer (transmitter) projects a beam of high frequency sound across a gap where it is either received directly by a microphone (receiver) on the other side of the gap or is reflected back to a microphone. As the edge of a web enters the gap, it partially blocks the sound beam, with the sound energy received by the microphone being roughly inversely related to the percentage of occlusion of the sound beam by the web. The relationship between the degree of occlusion and the signal provided by the microphone can be determined for a particular web material and the processing electronics which receives the signal can be adjusted accordingly so that the final control signal is truly proportional to the lateral position of the web edge.

While ultrasonic web detectors enjoy several advantages over other types of edge sensors, various ambient operating conditions can affect the accuracy of the control signals produced by the sensing system. For example, changes in the relative humidity of the ambient air can affect the propagation of the ultrasonic signal and thereby affect calibration, so that a sensor which is properly calibrated on one day may be somewhat off in its readings the next day when the ambient atmosphere has a different relative humidity. Preferably, the edge detector should be relatively insensitive to the elevational position of the web in the gap so that as the web moves toward or away from the receiving transducers because of transient undulations in the traveling web, the sensor does not interpret these motions as changes in the lateral position of the web. Conventional non-pulsed ultrasonic sensors have problems due to the continuous nature of the sensing beam of energy. Reflections of this energy will cause interference from the reflective energy to be sensed in addition to the desired portion of the unblocked beam. These reflections are portions of the ultrasonic energy that have been returned to the detector sensor after bouncing off of objects not in the immediate area of the transducers and can interfere with and greatly reduce the accuracy of the sensors. This reflected energy problem can be reduced by pulsing the ultrasonic signal from the transducer. A particular problem that has been experienced under certain conditions with pulsed ultrasonic transducers is the phenomenon of "ringing", in which the transmitter continues to oscillate after it has received a burst of signal energy near the resonant frequency of the transmitter. Other conditions which can affect the accuracy of the reading from the edge sensor include the temperature of the air, which also affects the sound conduction of the air in the gap, the temperature of the ultrasonic transducers which affects their sensitivity, and air currents in the gap which can cause transient variations in the signal produced by the sensor and which effectively add a "noise" component to the signal of interest.

SUMMARY OF THE INVENTION

The present invention provides ultrasonic web edge detection which is relatively invariant to changes in ambient conditions, such as temperature, humidity, air or adding nitrogen or other cases to the ambient air currents and the elevational position of the web, to produce an output control signal which is a highly reliable estimate of the web edge position. The apparatus of the invention utilizes a detector head with a gap into which the web can pass. A blockage transmitter transmits a beam of ultrasound across the gap to a blockage receiver with the edge of the web partly occluding this beam. The detector head further includes a compensation transmitter and compensation receiver mounted in close proximity to the blockage transmitter and blockage receiver to transmit a second beam of ultrasound across the gap at a position which will not be occluded by the web. Any transient ambient conditions which will affect the transmission of sound across the gap, such as changes in air temperature or humidity, or transient air currents, will affect the beam between the compensation transmitter and compensation receiver in substantially the same way as the beam between the blockage transmitter and the blockage receiver. A signal from the compensation receiver may then be utilized to compensate or normalize the signal from the blockage receiver so that the effects of changes in the aforesaid transient conditions can be cancelled out. The analysis of the signals from the two receivers is preferably carried out in a controller employing a microprocessor which receives a digitized version of the signals from the two receivers and utilizes software programming to provide the proper compensation or normalization. The microprocessor may also be programmed to properly accommodate the particular material of the web to provide an accurate reading of web position.

The apparatus of the invention also preferably utilizes a pulsed sound output operation in a manner which reduces the ringing that may otherwise occur. Each of the transmitters is controlled by the microprocessor to provide an output pulse comprised of a properly shaped high frequency sound signal, preferably at a frequency of approximately 200 kHz. Such high frequency signals result in a particularly narrow and well defined beam of sound across the gap in the detector head, enhancing the accuracy of the measurement of web position since the sound which passes the edge of the web will spread less than conventional lower frequency sound signals, which are usually in the range of 40 kHz or less. In addition, the pulse is preferably composed of two half portions at the desired frequency, with the second half portion being preferably 180° out of phase with the first half portion. The change in phase of the sound signal has the effect of reducing the ringing of the transmitter transducer since the energy in the second half of the input signal to the transducer is out of phase with any resonance that has built up in the transducer during the first half of the input signal. Generally, the optimal frequency to obtain the minimum length of required pulse width is the resonant frequency of the transducer. By properly forming the driving pulse to the transducer, particularly with the phase reversal, a driving pulse can be used which is at the resonant frequency of the transducer without producing excessive ringing. The result is a short pulse burst having an envelope with a well defined peak. The electrical output signal from the receiver can be evaluated to measure the peak of the envelope of the received signal, with the value of the peak being roughly inversely related to the portion of the beam which is occluded by the web.

The output of the blockage receiver or the compensation receiver is a series of pulses which are analyzed to provide a series of pulse peak magnitude values; these are utilized by the microprocessor controller of the system to determine the relative web edge position. The series of numerical values which are received by the microprocessor corresponding to these peak measurements will contain information on the actual position of the web edge corrupted by non-systematic time varying signals which are unrelated to web position, i.e., "noise". This noise may be due to such transient phenomena as localized air currents, dust, dirt, spurious sound signals which are picked up by the receiver, rapidly varying changes in the elevational position of the web, and so forth. Generally, these noise components will change at a rate faster than the rate at which web position would ordinarily change. To minimize the effects of these higher frequency noise components, the pulse height data is preferably smoothed by the microprocessor controller by performing a weighted averaging of the input data, with each new pulse sample value being added in a properly weighted manner with an average of a desired number of previous values. In this manner, the control signal provided by the apparatus is relatively stable and nonsusceptible to transient disturbances.

The detector head of the present invention may be carried out in alternative embodiments, including a structure in which the transmitters and receivers are located at positions remote from the position of the web itself. For example, where a web is to be measured in a high temperature environment, such as in a dryer oven for photographic film, a web head may be utilized which is comprised of ultrasonic wave guides, formed as tubes, which extend from the transmitters and receivers located outside the dryer oven, through a wall of the oven, to positions inside the oven wherein the tips of the tubes define the sensing gap through which the web edge will pass. The tips of the tubes which extend to the compensating transmitter and compensating receiver are positioned closely adjacent to the ends of the tubes for the blockage transmitter and blockage receiver so that the conditions across the tips of the two sets of tubes will be substantially similar.

Further objects, features, and advantages of the invention will be apparent from the following detailed description when taken in conjunction with the accompanying drawings.

DETAILED DESCRIPTION OF THE INVENTION

Figure 1:
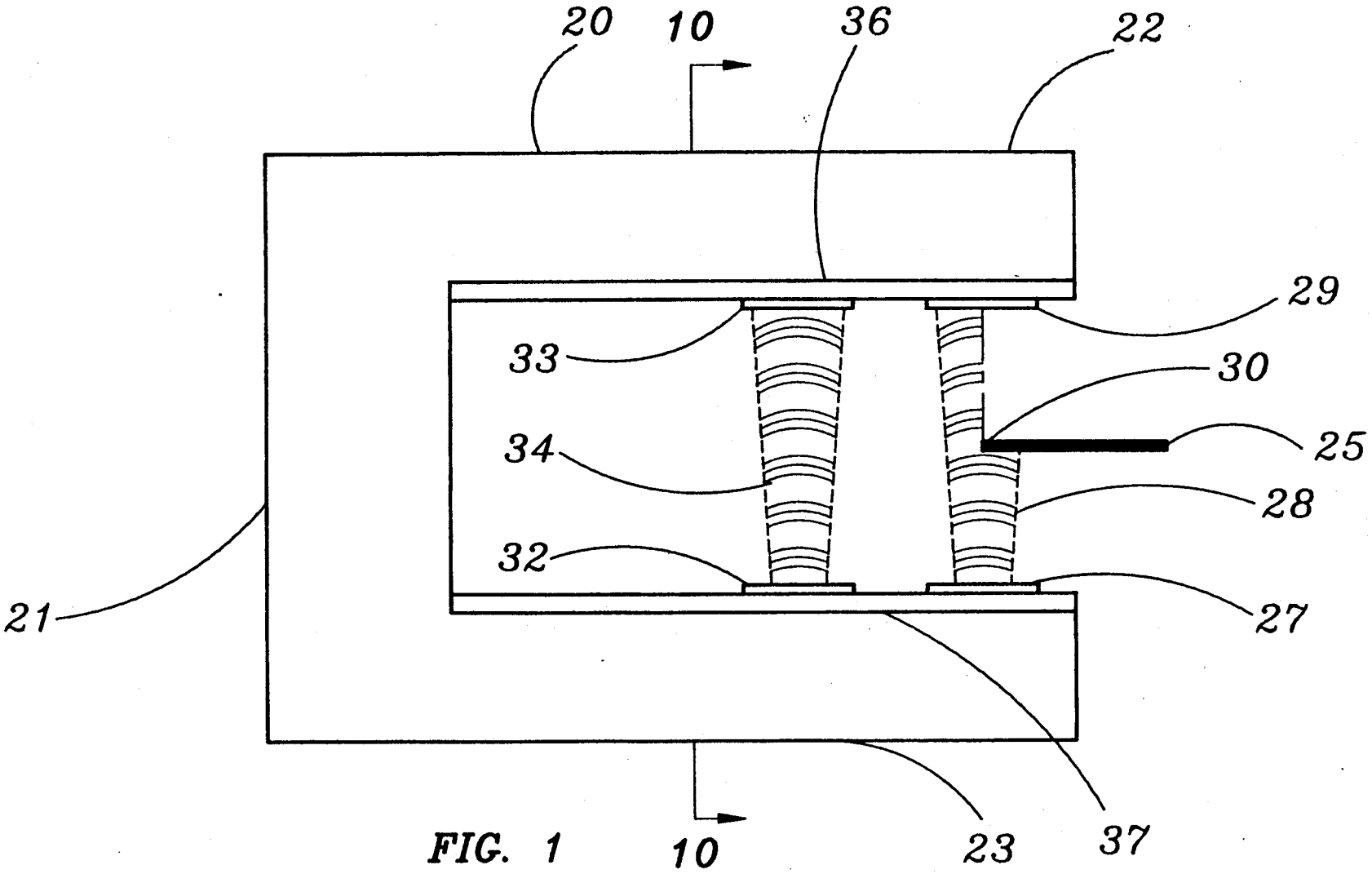
FIG. 1 is a simplified elevation view of a preferred detector head of the present invention having a blockage transmitter and a blockage receiver across a web sensing gap and a closely adjacent compensation transmitter and compensation receiver.

A detector head in accordance with the present invention is shown generally at 20 in FIG. 1, comprising a metal frame having a central base section 21, an upper arm 22, and a lower arm 23. The upper and lower arms 22 and 23 extend from the base and define a gap between them into which a web 25 of material such as paper or film can pass. A blockage transmitter 27 mounted to the arm 23 transmits a narrowly defined beam 28 of ultrasound across the gap to a blockage receiver 29, mounted to the other arm with the edge 30 of the web 25 shown blocking a part of the beam 28 for illustrative purposes in FIG. 1. Generally, the magnitude of energy in the ultrasound that will be received by the blockage receiver 29 will be roughly inversely related to the percentage of the beam 28 that is being occluded by the web 25, thus defining a relationship between the edge 30 of the web and the energy received by the receiver 29.

Figure 10:
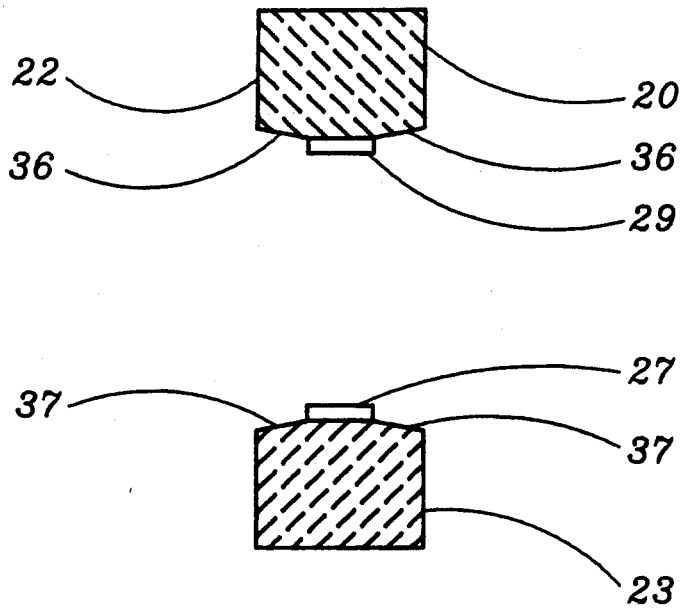
FIG. 10 is a cross-sectional view of the detector head taken along the lines 10—10 of FIG. 1.

The detector head 20 also includes a compensation transmitter 32 mounted to one of the arms 23 and a compensation receiver 33 mounted across the gap to receive a beam of ultrasound 34 from the transmitter 32. The compensation transmitter 32 is mounted in close proximity to the blockage transmitter 27 and, similarly, the compensation receiver 33 is mounted in close proximity to the blockage receiver 29. The exact positioning of the transmitters and receivers is not critical, although the respective transmitters and receivers should be close enough together so that each of the beams 28 and 34 encounter substantially the same ambient air conditions. Generally, the transmitters and receivers may be positioned approximately an inch or two apart to yield satisfactory performance. It is preferred, although not necessary, that each of the transmitters be substantially identical in characteristics and similarly that each of the receivers be substantially identical. Under such conditions, the outputs of the receivers 29 and 33 should be substantially the same under similar ambient air conditions. However, the apparatus of the invention can be programmed to accommodate differences in the characteristics of the respective transmitters and receivers so that the output signal from the compensation receiver can be utilized to normalize or compensate the output signal from the blockage receiver in a satisfactory manner. The arms 22 and 23 preferably have beveled inwardly facing surfaces 36 and 37, respectively, as best shown in FIG. 10 to minimize reflections of sound energy off of the arms back toward the receivers.

The transducers 27, 29, 32 and 33 may comprise, for example, conventional piezoelectric transducers consisting of a crystal disk with metal films on its two flat parallel faces to which alternating electrical potential is applied to cause the disk to vibrate. A preferred transducer is a Murata-Erie model MA200A1. The transducer may be in an "open" design in which the piezo element is mounted behind a protective screen or a closed design in which the piezo element is mounted directly on the underside of the top of the case which is formed to resonate at the desired frequency.

Figure 3:
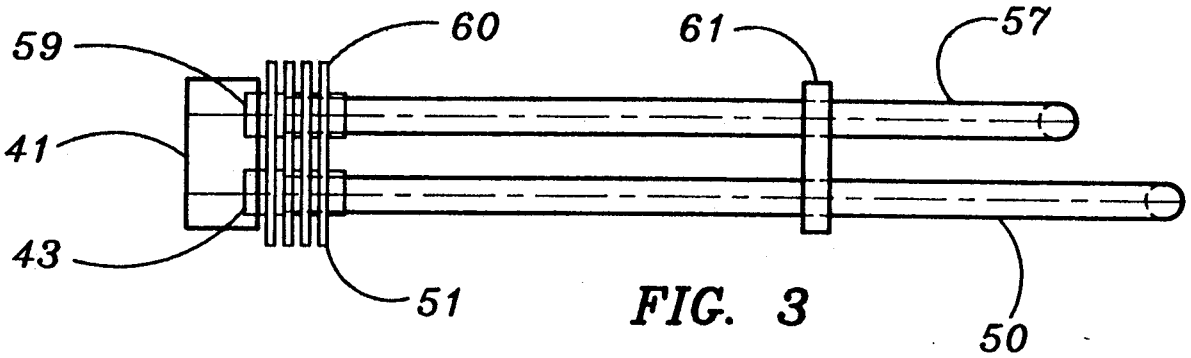
FIG. 3 is a top view of the remote sensing head of FIG. 2.
Figure 2:
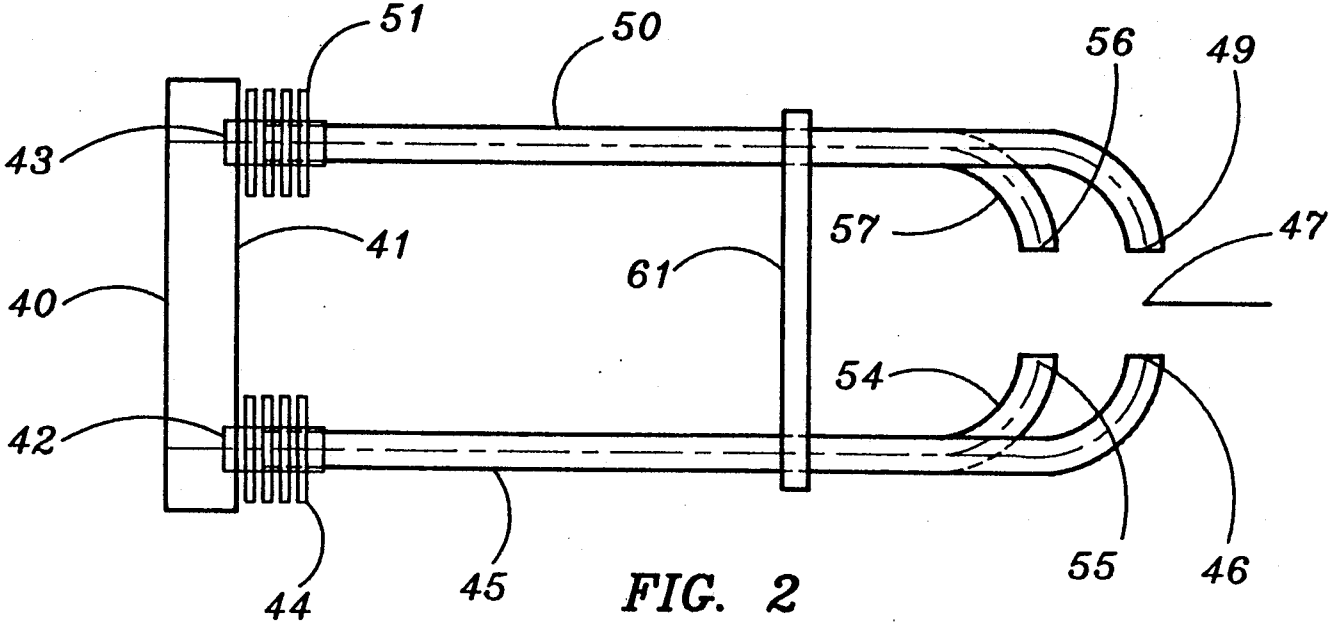
FIG. 2 is an elevational view of a detecting head for sensing web edge position in hostile environments, such as within an oven, with ultrasonic wave guides being utilized to transmit the ultrasonic pulses to and from the gap to transmitters and receivers located at remote positions.

Another structure for the detector head of the present invention is shown generally at 40 in FIG. 2. This head is especially adapted for sensing the position of a web in a hostile environment, such as within a dryer oven through which a plastic web or film web is passed. The detector head 40 has a base section 41 which contains a blockage transmitter 42 and a blockage receiver 43. The signal from the blockage transmitter 42 is transmitted through a heat insulating coupler 44 to a hollow tube 45, which serves as an ultrasound wave guide, which has a tip 46 which is positioned at one end of a gap through which the web 47 passes. On the other end of the gap is the tip 49 of an ultrasound wave guide 50 which transmits the ultrasound energy received at the tip 49 back to the receiver 43, with an insulating coupler 51 connecting the tube-like wave guide tube 50 to the base 41. Similarly, the compensation transmitter (not shown in FIGS. 2 and 3) is mounted to the base 41 and transmits an ultrasound signal through a hollow tube wave guide 54 to a tip 55 at one side of the gap. A tip 56 of a hollow tube wave guide 57 receives the sound and directs it back to a receiver 59, with the tube wave guide 57 being connected to the base 41 through an insulating coupler 60. The wave guides 45, 50, 54 and 57 extend through the walls 61 of the oven, with the base 41 containing the transducers mounted at a position remote from the wall of the oven so that the sensitive transducers are not exposed to the heat from the oven. The heat transmitted through the metal of the tube-like wave guides is insulated from the transducers by the insulating couplers. In this manner, the compensation transmitter and compensation receiver can accurately sense the ultrasound transmission conditions inside the oven, and the apparatus of the present invention can utilize the information from the compensation receiver to compensate accurately the signal received from the blockage receiver.

It should be understood that the detector head of the present invention may also utilize reflection of the ultrasound signal across the gap. In such a case, the blockage transmitter and blockage receiver would be mounted on one side of the gap adjacent to one another and the compensation transmitter and compensation receiver would similarly be mounted on the same side of the gap (which may or may not be the same side as the blockage transmitter and receiver). To minimize cross signal interference between the two transmitters and receivers, it is preferred that each pair of transmitters and receivers be mounted laterally spaced from one another, in a manner analogous to the way in which the tips 55 and 56 of the wave guides for the compensation transmitter and receiver are spaced away from the tips 46 and 49 of the wave guides of the blockage transmitter and receiver.

Figure 4:
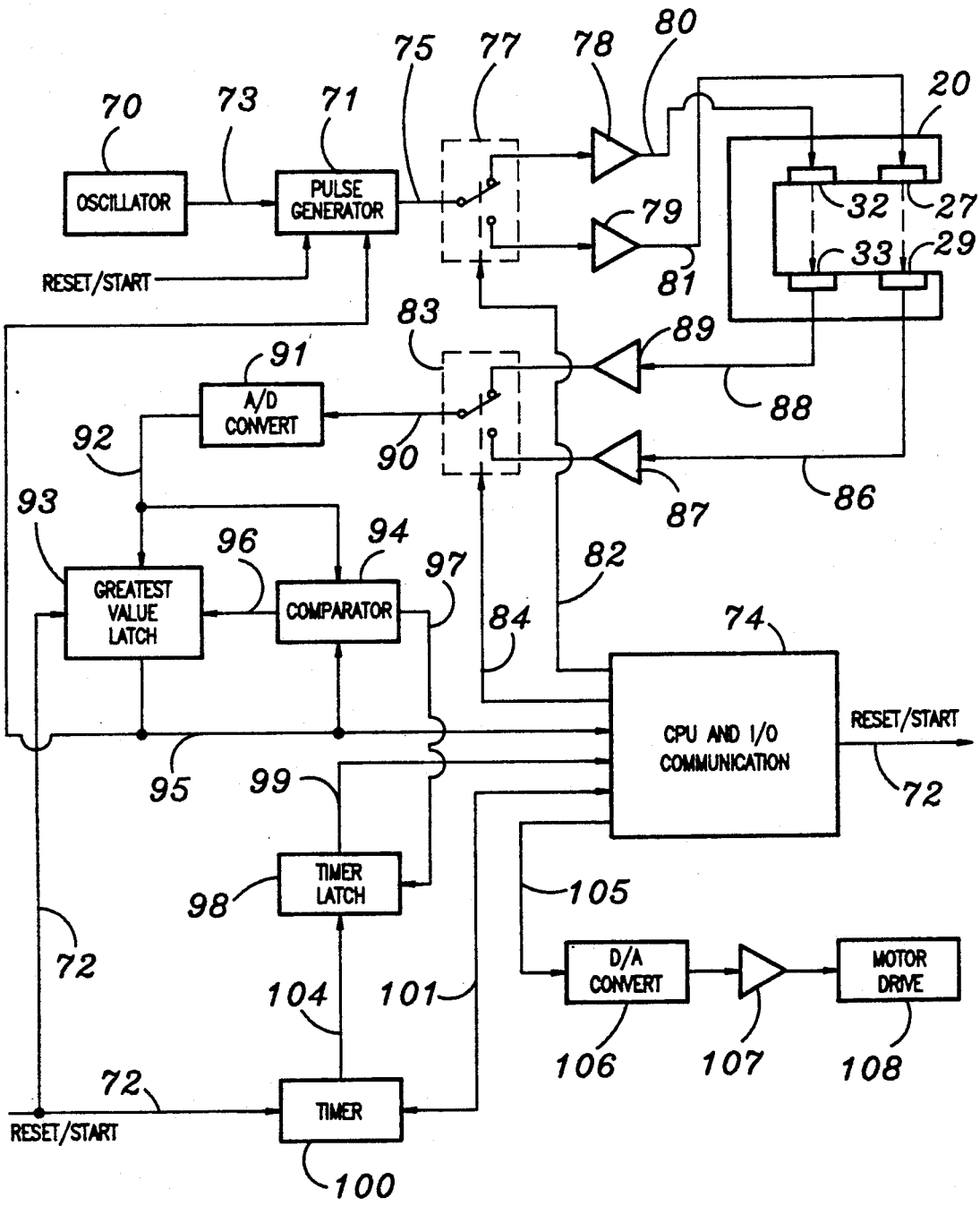
FIG. 4 is a simplified block diagram of the web edge detection apparatus of the present invention.

The transducer drive and signal processing components of the ultrasonic edge detection apparatus of the present invention are shown in simplified block diagram form in FIG. 4. An oscillator 70 generates continuous timing pulses at a proper frequency and provides these pulses on a line 73 to a pulse generator 71 which is controlled via control lines and data bus 95 by the computer control unit 74 of the system to provide a desired output drive pulse, on a line 75, of a form and in a manner which is described further below. The output on the line 75 is provided through a multiplexer 77 to either a first amplifier 78 or a second amplifier 79. The output on a line 80 from the first amplifier 78 leads to the compensation transmitter 32 and the output from the amplifier 79 on a line 81 leads to the blockage transmitter 27. The multiplexer 77, controlled by the computer controller 74 by a control signal on a line 82, allows the pulses from the pulse generator 71 to be directed to either the compensation transmitter or to the blockage transmitter, in a desired fashion, which may be alternating pulses, or, if desired, some other sequence. For example, the blockage transmitter may receive more pulses than the compensation transmitter since the conditions that the compensation transducers detect change relatively slowly compared to the web movement.

The output signal from the blockage receiver 29 on a line 86 is provided to an amplifier 87 and then to a multiplexer 83 which is controlled by a line 84 from the computer controller 74. Similarly, the electrical output signal from the compensation receiver 33 is provided on an output line 88 through an amplifier 89 to the multiplexer 83. The multiplexer 83 is set up to connect its output line 90 to the proper one of the amplifiers 87 or 89 so that the signal on the output line 90 will be from the blockage receiver 29 when it is desired to measure the pulses from the blockage transmitter 27 and will be from the compensation receiver 33 when it is desired to measure pulses from the compensation transmitter 32.

The signal on the output line 90 from the multiplexer 83 is a continuous time varying or analog electrical signal which corresponds to the sound signal detected by one of the receivers 29 or 33. This analog signal is converted to digital data by an analog to digital converter 91. The converter 91 has a sample rate which is fast enough to obtain all the information in the signal on the line 90. For example, as explained further below, it is preferred that the frequency of the ultrasonic pulses from the transmitters 27 and 32 be at approximately 200 kHz. To properly sample this signal, the converter 91 thus must sample at least the Nyquist rate of 400 kHz, and preferably at a somewhat higher rate.

The output data from the A to D converter 91 is provided to a greatest value latch 93 and to a comparator 94. Both the latch and the comparator 94 are in communication with the computer controller 74 by a communications bus 95. The state of the comparator is also provided on a line 96 to the latch 93 and the latch also receives the reset/start signal on the line 72 from the computer controller 74. The comparator also provides its state on a line 97 to a timer latch 98, the output of which is provided on a bus 99 to the computer controller 74. The computer 74 is also in communication with a timer 100 by a communications bus 101 and by providing the reset/start signal to the timer on the line 72. The output of the timer 100 is provided on a line 104 to the timer latch 98. The computer controller 74 processes the signals that it receives and provides an output data signal on lines 105 to a digital to analog converter 106, the analog output of which is provided through an amplifier 107 to a motor driver 108 which drives a motor or valve controller for controlling a positioning roller or other Web Guide Device (not shown) to laterally position the moving web to correct the position of the web.

The amplifier circuits 87 and 89 also preferably include band-pass filters centered at 200 kHz and the amplifiers may be of variable gain to allow gain control of the signals from the receivers. The computer controller 74, under control of its software, selects one of the channels from the amplifier 87 or 89 to be further conditioned and read by the analog to digital converter 91. Typically, a converter can be used which requires signals to be in the range of 0 to 5 volts so that all negative signals or excursions must be converted to that range by conditioning circuits (not shown). Several options are available for conditioning and can be selected by another analog multiplexer (not shown). The signal may be passed on as is, or inverted, and the magnitude of the signal brought to within the desired voltage range. The signals from the ultrasonic receivers will be pulse bursts at 200 kHz. As explained further below, since the control program is evaluating the burst for a maximum or pulse peak, the signal must be converted to a rectified output to allow sampling in the range of 0 to 5 volts. The circuits 87 and 89 provide this rectification and selective filtering.

The analog to digital converter is preferably a high speed microprocessor compatible device, e.g., with an 8 bit output, which has a conversion rate high enough to adequately sample the 200 kHz pulse signal. For example, the conversion sample period may be 1.95 microseconds to sample the signal.

Referring again to FIG. 4, when the computer controller 74 provides a reset signal on a line 72, the greatest value latch 93 is reset to its initial value and the timer 100 is reset. The computer controller 74 then puts out a start signal on a line 72 which starts the timer 100 and enables the greatest value latch 93. The start signal on line 72 also enables the pulse generator 71 which puts out a pulse to either the blockage transmitter 27 or the compensation transmitter 32. When the pulse from the transmitter reaches the proper receiver, output data will be fed from the analog to digital converter 91 to the comparator 94 and the greatest value latch 93. The comparator 94 continuously compares the value stored in the greatest value latch 93 with the new incoming data on the output line 92 from the converter 91. When the comparator determines that the new value on the line 92 is greater than the value in the latch 93, the comparator provides an output signal on its output line 96 to enable the latch to accept the new value that is on the line 92 at that time. Simultaneously, the comparator provides an output signal on a line 97 to the timer latch 98 to enable the timer latch to accept and store the new time value from the timer 100 at the time when the comparator enabled the greatest value latch to accept the new value. In this manner, the greatest value latch 93 will ultimately contain the peak value of the pulse signal from the receiver and the timer latch 98 will contain the time at which this peak value occurred. If a transducer is placed such that a signal can be read that is a component of a reflected pulse, then once the acquisition is complete, the computer controller 74 can read the timer latch 98 to derive the time position of the peak relative to the start of the pulse and thereby determine the physical distance of the web material from the transducer. Such a reflected pulse may be obtained by utilizing a third receiver (not shown) that may be mounted closely adjacent the blockage transmitter 27 and whose output signal would be transmitted through another channel passing through the multiplexer 83 to the A to D converter 91.

Figure 6:
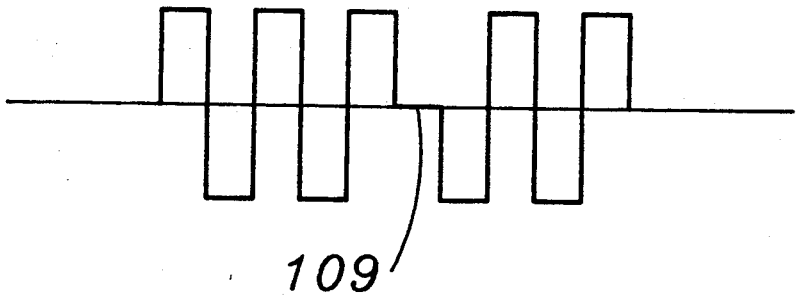
FIG. 6 is the preferred waveform for the electrical pulse drive signal applied to the transmitters.
Figure 7:
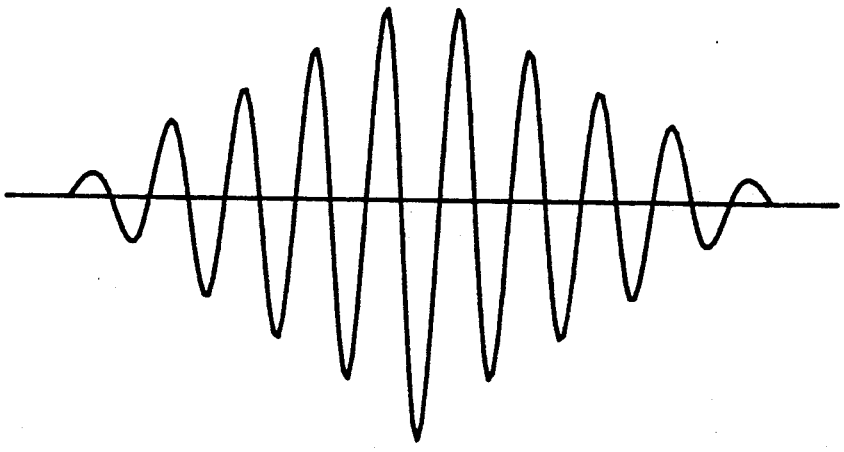
FIG. 7 is an illustrative view of the output waveform from a transmitter receiving the drive signal of FIG. 6.

The pulse generation is designed to control the pulse burst frequency to allow the minimum possible pulse width. The oscillator 70 may comprise, for example, a 20 mHz clock source and a programmable frequency divider so that the output of the oscillator 70 is at the desired frequency, which is preferably the resonant frequency of the transmitters 27 and 32. The pulse generator 71 acts to gate the output from the oscillator 70 to provide a particular pulse sequence when the start signal is provided from the computer controller on the line 72. The pulse generator 71 processes the output signal from the oscillator preferably to provide a series of pulses of the form illustrated in FIG. 6. The period of the oscillation is 5 microseconds for a 200 kHz frequency, with each half pulse being 2.5 microseconds in width. However, the oscillating signal undergoes a phase reversal halfway through the third pulse at a position indicated at 109 in FIG. 6, dividing the pulse signal provided on the line 75 into a first half portion and a second half portion, with the second half portion being 180° out of phase with the first half portion. When the waveform of FIG. 6 is provided to either of the transducers 27 or 32, where the carrier frequency of the pulse oscillation is at or close to the resonant frequency of the transducers, the output ultrasound pulse has the waveform of FIG. 7, building up to a maximum at the end of the drive pulse of FIG. 6 and then decaying back to zero.

Figure 5:
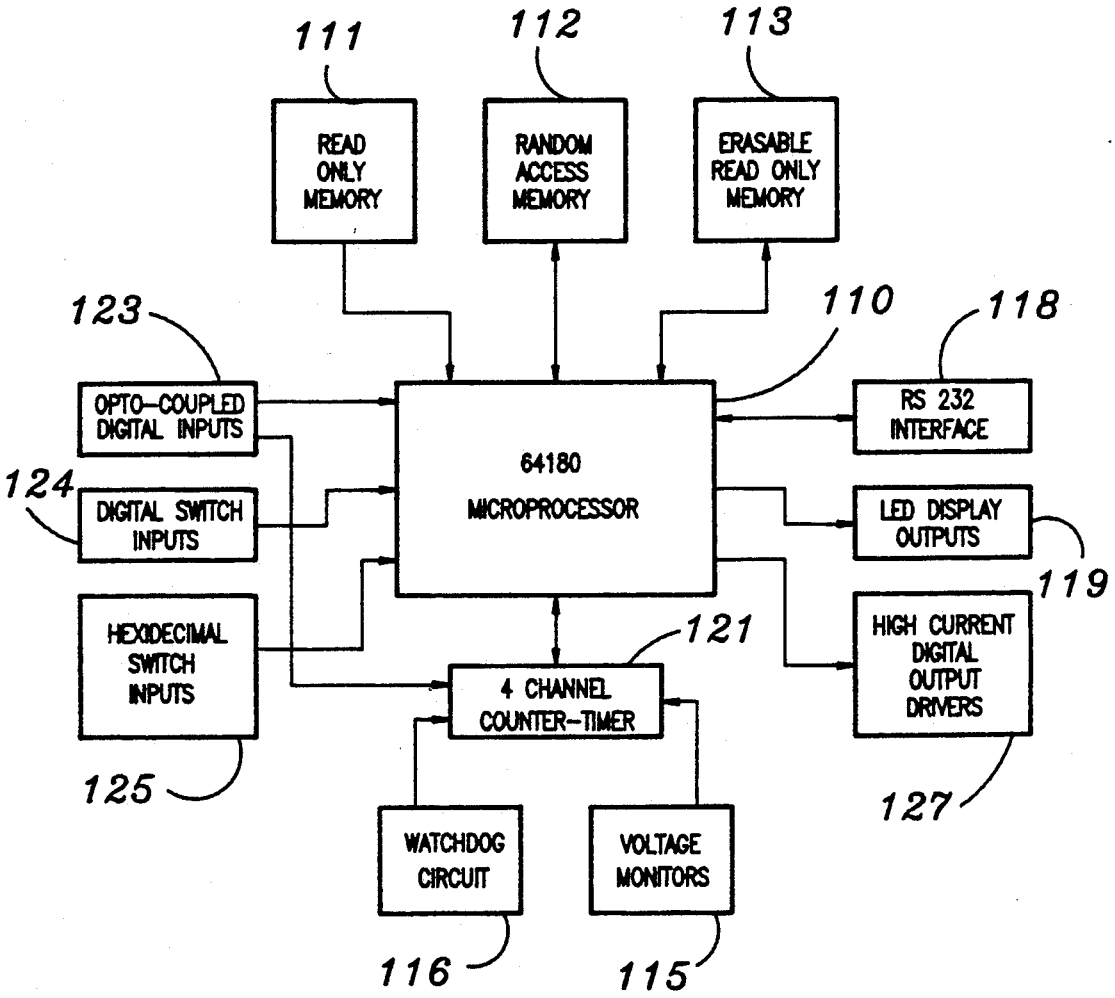
FIG. 5 is a block diagram of the computer controller for the apparatus of the invention.

A further block diagram of the computer controller with its input/output communications, comprising the block 74 in FIG. 4, is shown in FIG. 5. The computer controller includes a microprocessor 110 (e.g., a 64180 processor running at 6 MHz) with associated read only memory 111, random access memory 112, and erasable read only memory 113. A voltage monitor circuit 115 and a watchdog circuit 116 are utilized to ensure relatively fault free operation. A pair of serial interfaces through an RS-232 drive/receive interface 118 provide communication options, while a dual digit LED display 119 can provide basic diagnostic indications. A four channel counter/timer 121 can be configured as desired to be used in several ways under the control of software. Digital inputs are received by the microprocessor through optical couplers 123, which are connected to signals or switches located at a distance from the microprocessor, and digital switch inputs 124 and hexadecimal switch inputs 125 from front panel switches and push buttons provide direct communication by the user with the microprocessor. Digital outputs are provided from the microprocessor through high current digital output drivers 127.

Figure 8:
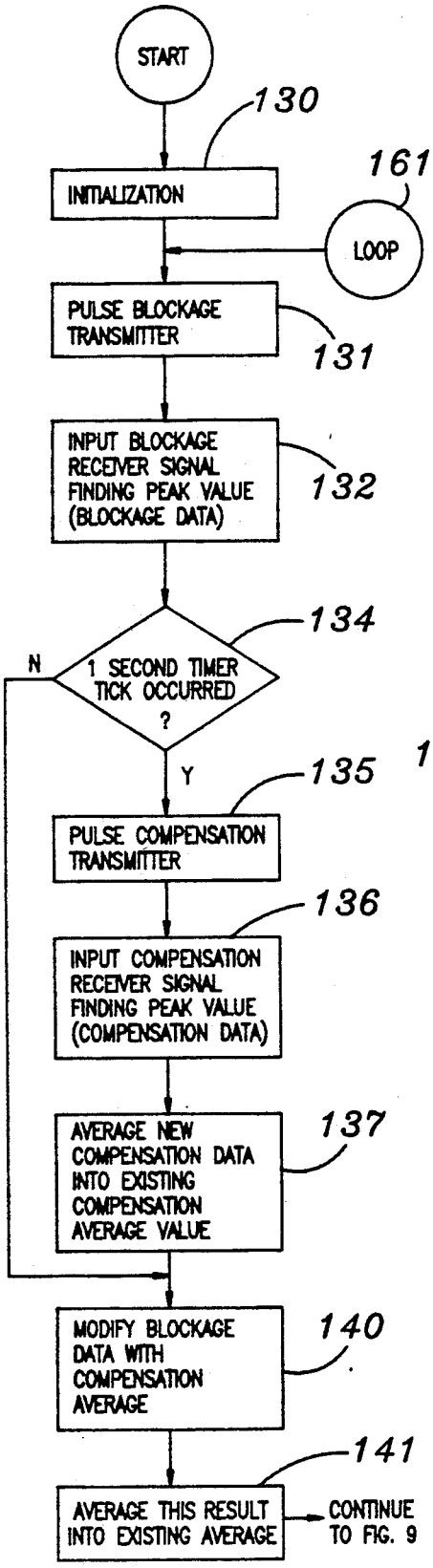
FIGS. 8–9 are flow diagrams showing the steps carried out by the computer controller of the invention during system operation.
Figure 9:
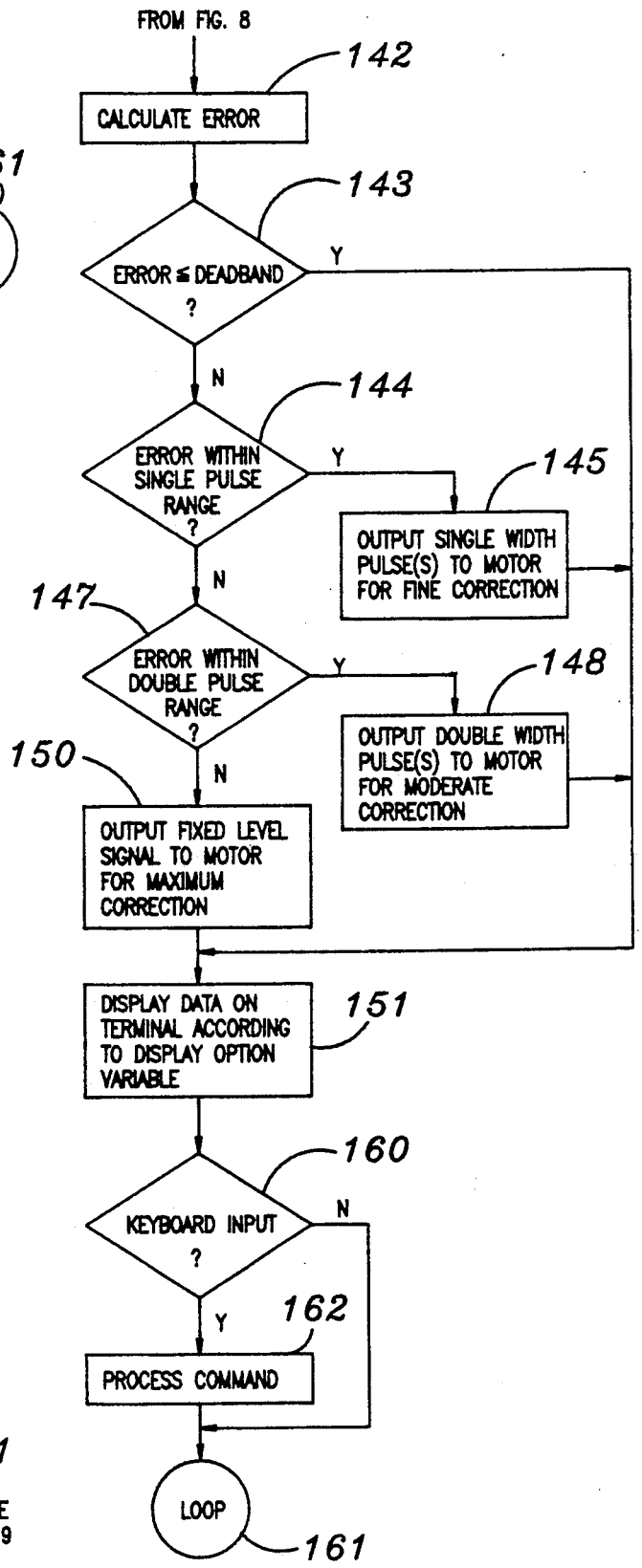

A basic flow diagram of the operation of this system as controlled by the computer controller 74 is set forth in the FIGS. 8–9. With reference to FIG. 8, after the program start, the system carries out initialization of all process parameters (block 130) and then proceeds to cause a pulse to be sent to the blockage transmitter (block 131). The program then receives the blockage receiver signal, finding and storing the peak value (132). The timer is then checked to see whether one second has elapsed from the time that the command to pulse the blockage transmitter was sent (block 134); if it has, the compensation transmitter is then pulsed (block 135), the signal from the compensation receiver is received, its peak value is found (block 136), and the new compensation data is then averaged into the existing compensation average value (block 137). The new compensation average value is then used in block 140 to normalize the blockage data. If at the decision block 134 it was found that the one second timer had not yet run, the program jumps blocks 135, 136, and 137 and immediately proceeds to normalize the blockage data with the compensation average (block 140). This normalization may be carried out in various ways as most appropriate for the data being analyzed. For example, the normalization may be accomplished by dividing the blockage value by the compensation average value. The normalization may also be carried out by subtracting the compensation average value from the blockage value, or by appropriate weighted subtractions or divisions. Any such modification is referred to herein as "normalization" or "normalizing". The compensated blockage value determined at 140 is then averaged into the existing average blockage value at 141. This averaging may be carried out in various desired ways to optimize to the particular process being controlled. For example, simple arithmetic averaging of the existing blockage value with the new blockage value can be utilized, or there may be a weighted average which weights the new value differently than the existing average value, or the average value may consist of an average taken over a previous set of values.

Different averaging techniques can be used which vary the weighting of the new sample vs. the old samples (existing average). As one example, the *compensation* data is averaged by weighting the new sample by $\frac{1}{4}$ and the existing average by $\frac{3}{4}$:

$$A(N) = \frac{S + 3A(N-1)}{4}$$

Where

A(N) = $N^{th}$ average

S = New sample

As a further example, the *blockage* data is averaged by weighting all of the samples in the average equally. The number (N) of samples in the average can be selected to be from 1 to 127. The most recent N samples are stored in memory. The averaging is done by calculating their sum and dividing by N. This can be called a "sliding" or "boxcar" average since all the samples used are given equal weight.

The new blockage sample (data) is preferably normalized by multiplying it by the ratio of the value of compensation data at "standard" conditions (temperature and humidity) divided by the current value of the compensation data. The current compensation data used is the averaged compensation value.

At "standard" conditions, the normalizing factor is 1, making no change to the blockage data.

$$\text{Normalized value} = \frac{Vstd}{Vavg} \times S$$

Where

Vstd = Value of compensation data at standard conditions

Vavg = Current averaged compensation value

S = New blockage sample

The averaged and normalized value is then utilized to calculate the error or deviation from the set value which corresponds to the desired position of the edge of the web (block 142, FIG. 9). The error is the difference between the "null" value and the averaged normalized blockage value. The absolute value of this difference determines the magnitude of the correction signal output to the motor (blocks 143–150), and the sign of the difference determines the polarity (in or out).

The "null" value can be described as the "preselected value indicating the desired position of the web edge". Thus,

*ERROR = NULL – AVERAGED NORMALIZED BLOCKAGE SIGNAL*

The amount of the error is then checked to see whether or not it is within a dead band value (143). If not, the error is then checked to see whether it is within a single pulse range (144). The single pulse range is the amount of error which can be corrected by a single output pulse. If the error is within this range, the program outputs a single width pulse to the motor for fine correction (145). If the error is not within the single pulse range, it is then checked to see whether it is within the double pulse range (block 147). If the error is within the double pulse range, the system outputs a double width pulse to the motor (block 148) to accomplish moderate correction of the web position. If the error as checked at 147 is not within the double pulse range, the system outputs a fixed level signal to the motor to achieve maximum correction (block 150). Exits from the blocks 143 (if the error is within the dead band value), 145, 148 and 150 proceed to block 151 to display the data on the terminal to the operator in accordance with a selected display option.

After completion of display of data at block 151, the program then proceeds to check for keyboard input (block 160, FIG. 9), and if there is no input, then the program proceeds to loop back (161) to again pulse the blockage transmitter at 131. If there is keyboard input, the system then inputs the process command (bIock 162) from the keyboard to change the process parameters and proceeds to return back through the loop to begin the process again.

Figure 11:
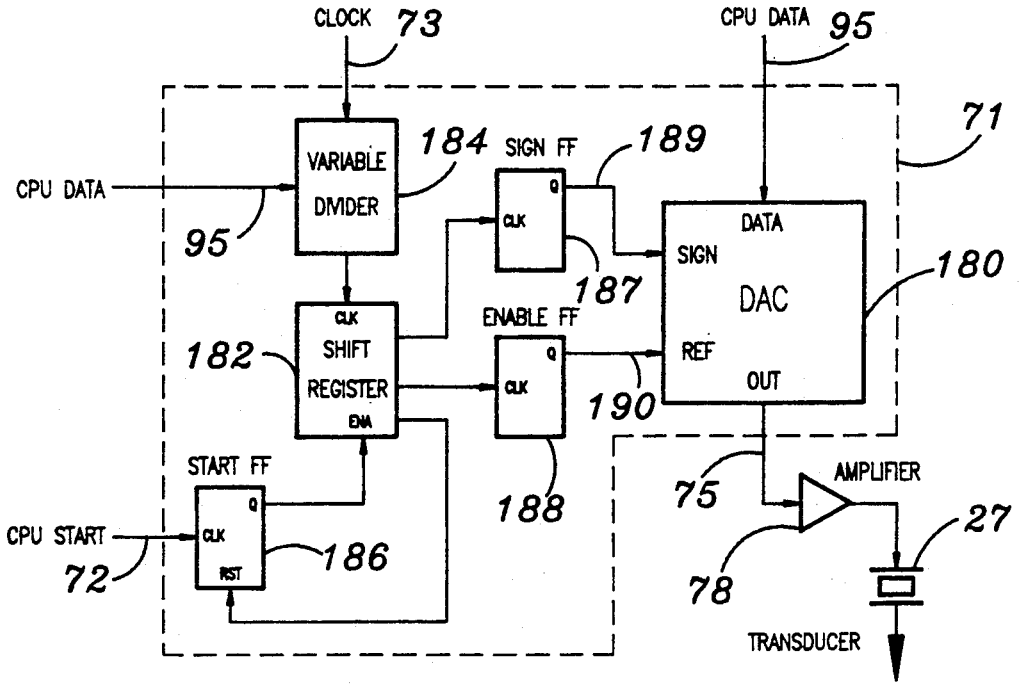
FIG. 11 is a more detailed block diagram of the pulse generator portion of the apparatus shown in FIG. 4.

The operation of the pulse generator 71 may be illustrated with reference to the more detailed block diagram of FIG. 11. The major element in the control of the output pulse train from the generator 71 is a 10 bit (plus sign) Digital-to-Analog converter (DAC) 180. By controlling the amplitude, sign and reference inputs digitally, complete control of the output pulse train can be accomplished. The amplitudes or pulse height is determined by an 8 bit data value from the computer controller 74 through data bus 95. Sign control on the line 189 determines whether the pulse is positive or negative while the Reference Input on the line 190 gates the pulse On or Off. Proper time sequencing as well as pulse width is controlled by an 8 stage shift register 182 whose clock frequency is determined by a variable count divider 184 under control of the computer controller. Pulse width control allows for the fine tuning of the resonant frequency of the transducers 27 and 32. Control logic in the form of flip-flops 186, 187, and 188 insures proper sequencing for start-up and for the gating of the sign and enabling (referencing) inputs. The output of the DAC is connected to the amplifier 78 for power gain prior to driving the transducer 27 (or transducer 32).

Operation proceeds as follows: 1) the computer controller 74 determines the proper values for the DAC amplitude and the variable divider data and places that data at the respective points in the circuit; 2) the CPU initiates a Start command which sets the Start Flip-Flop 186; 3) Control logic allows the Variable Divider 184 and Shift Register 182 to generate clock pulses; 4) Logic connection to the Shift Register sets the Sign and Enable flip-flops 187 and 188; 5) For each additional pulse generated by the Divider 184, the sign level will change states until five pulses have been generated; 6) At this time the Sign flip-flop 187 is inhibited and the Enable flip-flop 188 is cleared causing the DAC 180 output to go to zero for one cycle; 7) Additional clock pulses will now generate four more output pulses; 8) the last pulse results in a reset of all the logic until the computer controller 74 generates another sequence.

It is understood that the invention is not confined to the particular embodiments set forth herein as illustrative, but embraces all such modified forms thereof as come within the scope of the following claims.

What is claimed is:

1. Ultrasonic web edge detection apparatus comprising:

(a) a detector head having an ultrasonic blockage transmitter and an ultrasonic blockage receiver mounted so that sound from the transmitter passes across a gap to the receiver, the edge of a web being positioned into the gap, and an ultrasonic compensation transmitter and an ultrasonic compensation receiver mounted in close proximity to the blockage transmitter and blockage receiver and positioned so that sound from the compensation transmitter passes across the gap to the compensation receiver without contacting the edge of the web, the transmitters being responsive to electrical input signals to provide an ultrasonic sound output and the receivers responding to sound signals to provide an electrical output signal;

(b) means for applying selected drive signals to the blockage transmitter and the compensation transmitter to cause them to provide ultrasonic sound signals; and (c) means for receiving the output signals from the blockage and compensation receivers and for normalizing the signal from the blockage receiver with the signal from the compensation receiver whereby the position of the edge of the web can be determined from the normalized signal.

2. The apparatus of claim 1 wherein the drive signal frequency is about 200 kHz.

3. The apparatus of claim 1 wherein the detector head includes a base section and two spaced arms extending outwardly therefrom which define a gap between them into which the edge of a web can be inserted, wherein the blockage transmitter and compensation transmitter are mounted adjacent to one another on one arm and the blockage receiver and compensation receiver are mounted adjacent to one another on the other arm.

4. The apparatus of claim 1 wherein the detector head includes a base to which the blockage and compensation transmitters and receivers are mounted and sound wave guide tubes each extending from one of the transmitters and receivers at the base to a tip at a remote location, each sound wave guide tube mounted to direct sound between its remote tip and one of the transmitters and receivers, the tips of the wave guide tubes which are connected to the blockage transmitter and to the blockage receiver being positioned in facing relation across a gap into which a web edge passes and the tips of the compensation wave guide tubes which are connected to the compensation transmitter and receiver positioned in facing relation across a gap in proximate position to the tips of the wave guide tubes for the blockage transmitter and blockage receiver.

5. The apparatus of claim 1 including means for providing a control signal for driving a web controlling apparatus which is an error compensation signal formed as a function of the deviation of the compensated blockage signal from a null value indicating the desired position of the web edge.

6. The apparatus of claim 5 wherein the control signal is provided only if the error between the compensated blockage signal and the null value exceeds a selected deadband value.

7. The apparatus of claim 1 wherein the means for applying the drive signals to the blockage and compensation transmitters supplies drive signals in pulses.

8. The apparatus of claim 7 wherein each drive signal pulse has two half portions of identical frequency with the second half portion being substantially 180° out of phase with the first half portion, thereby minimizing ringing in the transmitters.

9. The apparatus of claim 7 wherein the means for receiving also includes means for determining the time elapsed from the start of the pulse drive signal applied to the blockage transmitter to the time of occurrence of the peak of the pulse signal received from the blockage receiver.

10. The apparatus of claim 7 wherein the means for receiving output signals from the receivers determines the peak value of the pulses in the output signal from each receiver.

11. The apparatus of claim 10 wherein the means for receiving periodically normalizes the value of the peak value from the blockage receiver with the peak value of the pulse from the compensation receiver.

12. The apparatus of claim 10 wherein the means for receiving averages the peak value of the most recently received pulse from the compensation receiver with a prior averaged value for that receiver, normalizes the most recent blockage receiver peak value with the averaged compensation receiver value and averages the normalized recent blockage receiver peak value with a prior averaged value.

13. The apparatus of claim 12 wherein the means for receiving includes a programmed microprocessor and associated memory and an analog to digital converter which converts the signals from the receivers to digital data which are supplied to the microprocessor, the microprocessor being programmed to carry out the averaging of the blockage receiver and compensation receiver peak values and the normalizing of the blockage receiver value with the averaged compensation receiver value.

14. Ultrasonic web edge detection apparatus comprising;

(a) an ultrasonic blockage transmitter and an ultrasonic blockage receiver arranged so that a sound signal from the transmitter passes across a gap into which a web edge is placed and is received by the receiver, the transmitter activated by a drive signal to provide a sound output and the receiver providing an electrical output signal corresponding to the sound received by it;

(b) means for providing a series of electrical pulses to the blockage transmitter, each pulse being formed of a shaped high frequency signal comprising two half portions with the second half portion being 180° out of phase with the first half portion; and (c) means for receiving the output signal from the blockage receiver to allow determination of the relative position of the edge of a web in the gap.

15. The apparatus of claim 14 wherein the high frequency in each pulse is about 200 kHz.

16. The apparatus of claim 14 wherein the means for receiving averages the peak value of the most recently received pulse in the signal from the receiver with a prior averaged value.

17. The apparatus of claim 14 wherein the high frequency signal forming the pulses to the transmitter is near the resonant frequency of the transmitter.

18. The apparatus of claim 14 wherein the means for receiving finds the peak values of pulses in the output signal from the receiver.

19. The apparatus of claim 18 wherein the means for receiving includes a programmed microprocessor and associated memory, and an analog to digital converter which converts the signal from the receiver to digital data which is supplied to the microprocessor, the microprocessor programmed to carry out the averaging of the peak values of the pulses in the signal received from the receiver.

20. Ultrasonic web edge detection apparatus comprising:

(a) an ultrasonic blockage transmitter and an ultrasonic blockage receiver arranged so that a sound signal from the transmitter passes across a gap into which an edge of web is inserted, the sound signal received by the receiver, the transmitter responsive to an electrical drive signal to provide the sound signal corresponding thereto and the receiver responsive to the sound signal to provide an electrical output signal corresponding thereto;

(b) means for providing a series of electrical drive pulses to the blockage transmitter, each pulse formed of high frequency signal; and (c) means for receiving the signal from the blockage receiver and finding the peak value of each pulse and further for averaging the peak value of the latest pulse from the receiver with an averaged value obtained from prior pulses to provide a present averaged peak value which is utilized to determine the position of the web edge in the gap.

21. The apparatus of claim 20 wherein the frequency of the signal of each pulse applied to the transmitter is about 200 kHz.

22. The apparatus of claim 20 wherein each drive signal pulse has two half portions of identical frequency and with the second half portion being substantially 180° out of phase with the first half portion, thereby to minimize the ringing in the transmitter to which the pulse is applied.

23. The apparatus of claim 20 wherein the means for receiving includes a programmed microprocessor and associated memory, and an analog to digital converter which converts the signals from the receiver to digital data which is supplied to the microprocessor, the microprocessor programmed to carry out the averaging of the peak values of the pulses received from the receiver.

24. The apparatus of claim 20 wherein the means for receiving also determines the time elapsed from the start of a pulse input signal supplied to the blockage transmitter to the time of occurrence of the peak of the pulse signal received from the blockage receiver.

25. The apparatus of claim 20 further including means for providing a control signal for driving a web controlling apparatus which is a function of the deviation error of the present averaged blockage signal value from a null value.

26. The apparatus of claim 25 wherein the control signal is provided only if the error deviation exceeds a preselected deadband value.

27. A detector head for ultrasonic web edge detection apparatus comprising;

(a) a base, an ultrasonic blockage transmitter, an ultrasonic compensation transmitter, an ultrasonic blockage receiver and an ultrasonic compensation receiver, all mounted to the base, the transmitters being responsive to an electrical input signal to provide a sound output signal corresponding thereto and the receivers being responsive to a sound signal to provide an electrical output signal corresponding thereto; and (b) sound wave guide tubes each mounted to the base and extending to a tip at a position remote from the base, each sound wave guide tube mounted to direct sound between its tip and one of the transmitters and receivers, the tips of the wave guide tubes connected to the blockage transmitter and the blockage receiver positioned in facing relation across a gap through which the edge of a web passes and the tips of the wave guide tubes connected to the compensation transmitter and compensation receiver positioned in facing relation across a gap which is placed at a position proximate to the tips of the wave guide tubes connected to the blockage transmitter and receiver and at a position whereby the web does not pass therethrough.

28. The detector head of claim 27 wherein each wave guide tube includes a thermal insulating coupler connecting the remaining portion of the wave guide tube to the base to provide thermal insulation of the base from the remainder of the wave guide tube.

29. A method of detecting the position of the edge of a web in a gap between an ultrasonic transmitter and a receiver, comprising the steps of:

(a) applying an electrical signal to the ultrasonic transmitter in a pulse composed of a ultrasonic carrier frequency, the pulse having two half portions at the carrier frequency with the second half portion being 180° out of phase with the first half portion;

(b) directing the pulse of sound from the transmitter across the gap at a position where the sound may be partially blocked by the edge of the web and thence to the ultrasound receiver; and (c) determining the magnitude of the pulse signal from the ultrasound receiver whereby the position of the edge of the web is related to the magnitude value of the pulse peak.

30. The method of claim 29 including the additional step of averaging the peak value of the most recent pulse from the receiver with the averaged peak values of prior pulses.

31. A method of determining the position of the edge of a web in a gap into which the web is passed, comprising the steps of:

(a) directing a pulse of ultrasound across the gap toward the edge of the web so that the sound is partially blocked by the edge of the web;

(b) receiving the sound passed by the edge of the web and providing an output signal corresponding to the pulse of sound received; and (c) determining the peak value of the pulse in the signal corresponding to the sound received and averaging the present peak value with the peak values of prior pulses to provide an averaged peak value which is related to the amount of the sound pulse which is blocked by the web and thereby the position of the edge of the web in the gap.

32. A method of determining the position of the edge of a web in a gap into which the web is passed, comprising the steps of:

(a) directing a first pulse of ultrasound across the gap toward the edge of the web so that the sound is partially blocked by the edge of the web;

(b) receiving the sound passed by the edge of the web and providing an output signal corresponding to the pulse of sound received and determining the peak value of the pulse in the signal corresponding to the sound received from the first pulse;

(c) directing another pulse of ultrasound across the gap at a position adjacent to the edge of the web but not blocked by the web;

(d) receiving the sound passed across the gap which is not blocked by the web and providing an output signal corresponding to the pulse of sound received and determining the peak value of that pulse; and (e) normalizing the peak value of the pulse which is partially blocked by the web with the peak value of the pulse which is not blocked by the web so that the position of the web edge will be indicated by the normalized value.

* * * * *